US007268736B1

(12) United States Patent
Tikhov et al.

(10) Patent No.: US 7,268,736 B1
(45) Date of Patent: Sep. 11, 2007

(54) SMALL RECTENNA FOR RADIO FREQUENCY IDENTIFICATION TRANSPONDER

(75) Inventors: Yuri Tikhov, Suwon-si (KR); Young-hoon Min, Anyang-si (KR); Young-eil Kim, Suwon-si (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 11/585,075

(22) Filed: Oct. 24, 2006

(30) Foreign Application Priority Data

May 26, 2006 (KR) ..... 10-2006-0047549

(51) Int. Cl.
*H01Q 1/38* (2006.01)

(52) U.S. Cl. ..... 343/770; 343/767; 340/572.7

(58) Field of Classification Search ..... 343/700 MS, 343/767, 770, 860, 895; 340/572.5, 572.7
See application file for complete search history.

(56) References Cited

U.S. PATENT DOCUMENTS

| | | | | |
|---|---|---|---|---|
| RE29,911 E | | 2/1979 | Munson | |
| 4,367,475 | A * | 1/1983 | Schiavone | 343/767 |
| 4,672,386 | A * | 6/1987 | Wood | 343/770 |
| 5,268,696 | A * | 12/1993 | Buck et al. | 342/372 |
| 5,907,305 | A * | 5/1999 | Epp et al. | 343/700 MS |
| 6,825,816 | B2 | 11/2004 | Aikawa et al. | |
| 7,091,918 | B1 * | 8/2006 | Bhansali et al. | 343/767 |
| 2005/0231434 | A1 | 10/2005 | Azadegan et al. | |
| 2006/0033624 | A1 | 2/2006 | Copeland et al. | |
| 2006/0038724 | A1 * | 2/2006 | Tikhov et al. | 343/700 MS |

FOREIGN PATENT DOCUMENTS

| | | | |
|---|---|---|---|
| JP | 4-345304 | A | 12/1992 |
| JP | 2003-324311 | A | 11/2003 |
| JP | 2004-221877 | A | 8/2004 |
| KR | 10-2006-0045003 | A | 5/2006 |

* cited by examiner

*Primary Examiner*—Tho Phan
(74) *Attorney, Agent, or Firm*—Sughrue Mion, PLLC

(57) ABSTRACT

A small rectenna including a thin conductive layer formed on a surface of a dielectric substrate and a slot pattern arranged within the thin conductive layer. The small rectenna for an RFID transponder includes: a dielectric substrate; a thin conductive layer formed on a surface of the dielectric substrate; a slot pattern configured within the thin conductive layer so that the rectenna has an enhanced gain and a greater operating bandwidth; and an inlet of an electronic chip including an ASIC in the slot pattern.

7 Claims, 14 Drawing Sheets

SMALL RECTENNA FOR RADIO FREQUENCY IDENTIFICATION TRANSPONDER

CROSS-REFERENCE TO RELATED APPLICATION

This application claims priority from Korean Patent Application No. 10-2006-0047549, filed on May 26, 2006, in the Korean Intellectual Property Office, the disclosure of which is incorporated herein by reference.

BACKGROUND OF THE INVENTION

1. Field of the Invention

Apparatuses consistent with the present invention relate to a radio frequency and a microwave rectenna, and more particularly to an electrically small antenna in combination with an electronic chip of a radio frequency identification (RFID) transponder.

2. Description of Related Art

An RFID transponder is a tag device that can respond to being read by sending a content of its embedded memory by backscatter communication to an interrogator, i.e. a reader. A passive RFID transponder has no battery; instead, it gets all the needed energy to send a signal to the reader, from a carrier signal of the reader.

Generally, the RFID transponder includes an application specific integrated circuit (ASIC) connected to an antenna. Low cost planar antennas for RFID transponders with substantially small electrical size have been heavily focused on in recent years. The reason being is that, currently, an antenna size of even a quarter of a wavelength is precluded from many applications.

Small antennas are constrained in their behaviour by a fundamental limit: the smaller the maximum dimension of the antenna, the higher the Quality Factor (Q), or equivalently, the narrower the frequency bandwidth. Accordingly, the art of antenna miniaturization is always an art of compromise between size, bandwidth, and gain. In the case of a planar antenna, a good compromise is usually obtained when most of the given areas of the antenna strongly participate in the radiation phenomenon.

The inventors have disclosed a small antenna that can operate over an enhanced bandwidth without affecting the radiation pattern, gain, and polarisation purity. Such antenna is described in Korea Patent Application No. 10-2005-0026496. The direct implementation of the antenna described in Korea Patent Application No. 10-2005-0026496 for an RFID transponder design faces important challenges. The ASIC included in the RFID transponder has essentially a complex input impedance with a substantial capacitive reactance. Therefore, the antenna impedance should be complex conjugate matched to the impedance of the ASIC. Impedance matching between a transponder ASIC and an antenna is critical for overall RFID system performance. Specifically, the mismatch very strongly affects a read range, i.e., a maximum operating distance between a reader and a transponder since the power radiated by the reader is rather limited due to certain safety regulations and other legislation. Also, a passive RFID transponder extracts its operating power by rectifying interrogation signals delivered by the antenna.

A rectifying circuit is within an ASIC and includes diodes, such as Schottky diodes, and capacitors, resulting in a complex input impedance with substantial capacitive reactance. Typically, the impedance of an ASIC comes to a few or tens of Ohms and a few hundred reactive (capacitive) Ohms. Thus, the ratio of the reactance to the resistance is very high.

Generally, the circuit including an antenna and a rectifying circuit is termed as a rectenna.

A related art rectenna is described in Korea Patent Application No. 10-2005-0026496.

FIG. 1 is a diagram illustrating a rectenna 1 in the related art. The rectenna 1 includes a rectifying circuit embedded into an ASIC 2 of a transponder and a connected antenna 3. The antenna 3 is shown separately in FIG. 2. The electrically small antenna 3 has a dielectric substrate 31; a thin metal layer 32 formed on a top surface of the substrate 31; and a slot pattern 33 within the metal layer 32. The metal layer 32 with the slot pattern 33 constitutes a radiating part of the antenna 3. The slot pattern 33 is shown separately in FIG. 3. The slot pattern 33 includes a main slot 331; four slot arms 332, 333, 334 and 335 terminating the main slot 331 at both ends of the main slot 331; a system of transverse slots 336 placed along the main slot 331 in such a manner that the system of the transverse slots 336 is divided into two mirror-symmetrical halves by the main slot 331. The antenna 3 is functionally fed by a direct inlet of an electronic ASIC chip in the slot pattern 33 at a feeding point 337.

Radar Cross Section (RCS) characterizes how an antenna scatters electromagnetic energy of an incident wave field. For backscatter communications, the RCS of a rectenna is a factor because a modulated RCS is essentially used for the transmission of data from a transponder to a reader.

Good impedance matching between an ASIC and an antenna increases the read range of an RFID system. The maximum read range also depends on the gain of the transponder antenna. Enhancement in gain basically allows an increased reading range.

The related art rectenna provides a conjugate matched small antenna having enhanced RCS for an overall increased bandwidth without affecting the radiation pattern and polarization purity. However the gain of the rectenna can be further enhanced.

Accordingly, it would be desirable to provide a rectenna with an electrically small conjugate matched antenna having an enhanced gain for an overall increased bandwidth without strongly affecting polarization and RCS characteristics.

SUMMARY OF THE INVENTION

The present invention provides a rectenna with an electrically small conjugate matched antenna having an enhanced gain for a overall increased bandwidth without strongly affecting polarization and RCS characteristics.

According to an aspect of the present invention, a small rectenna for an RFID transponder includes a dielectric substrate, a thin conductive layer formed on a surface of the dielectric substrate, and a rectifying circuit. Here, a slot pattern is configured on said conductive layer comprising a main slot and a plurality of angle sections placed along a main slot.

According to another aspect of the present invention, each of the angle sections is bent toward a nearest end of the two ends of the main slot, and the angle sections are divided into two mirror-symmetrical halves by the main slot.

According to yet another aspect of the present invention, the small rectenna includes a plurality of slot arms terminating the main slot at each of both ends of the main slot. Further, the slot arms comprise four convoluted slot arms, wherein one pair of the four convoluted slot arms is convoluted clockwise and a remaining pair of the four convoluted arms is convoluted counterclockwise.

According to still another aspect of the present invention, the convoluted slot arms are arranged as mirror-symmetrical couples with respect to a longitudinal axis of the main slot.

BRIEF DESCRIPTION OF THE DRAWINGS

The above and/or other aspects of the present invention will become apparent and more readily appreciated from the following detailed description, taken in conjunction with the accompanying drawings, in which.

DETAILED DESCRIPTION OF EXEMPLARY EMBODIMENTS

Figure 1:
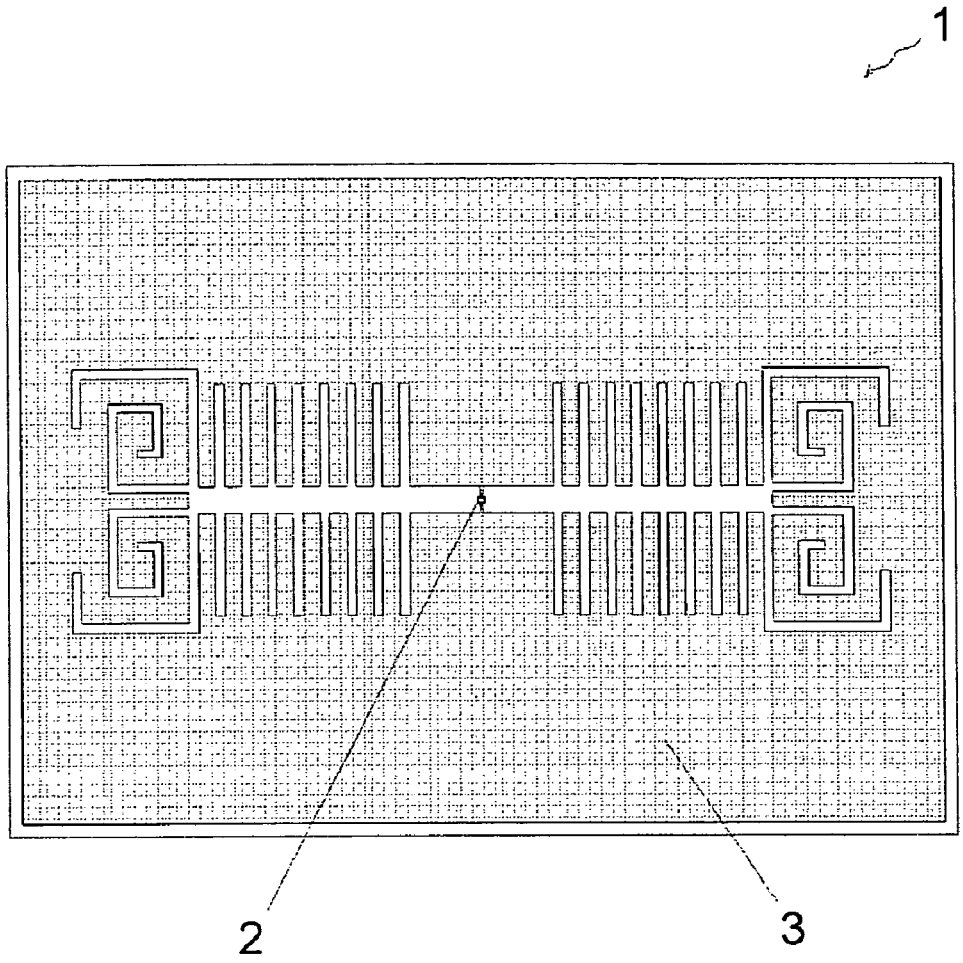
FIG. 1 (RELATED ART)
FIG. 1 is a diagram illustrating a rectenna according to a related art.

Reference will now be made in detail to exemplary embodiments of the present invention, examples of which are illustrated in the accompanying drawings, wherein like reference numerals refer to the like elements throughout. The exemplary embodiments are described below in order to explain the present invention by referring to the figures.

Figure 4:
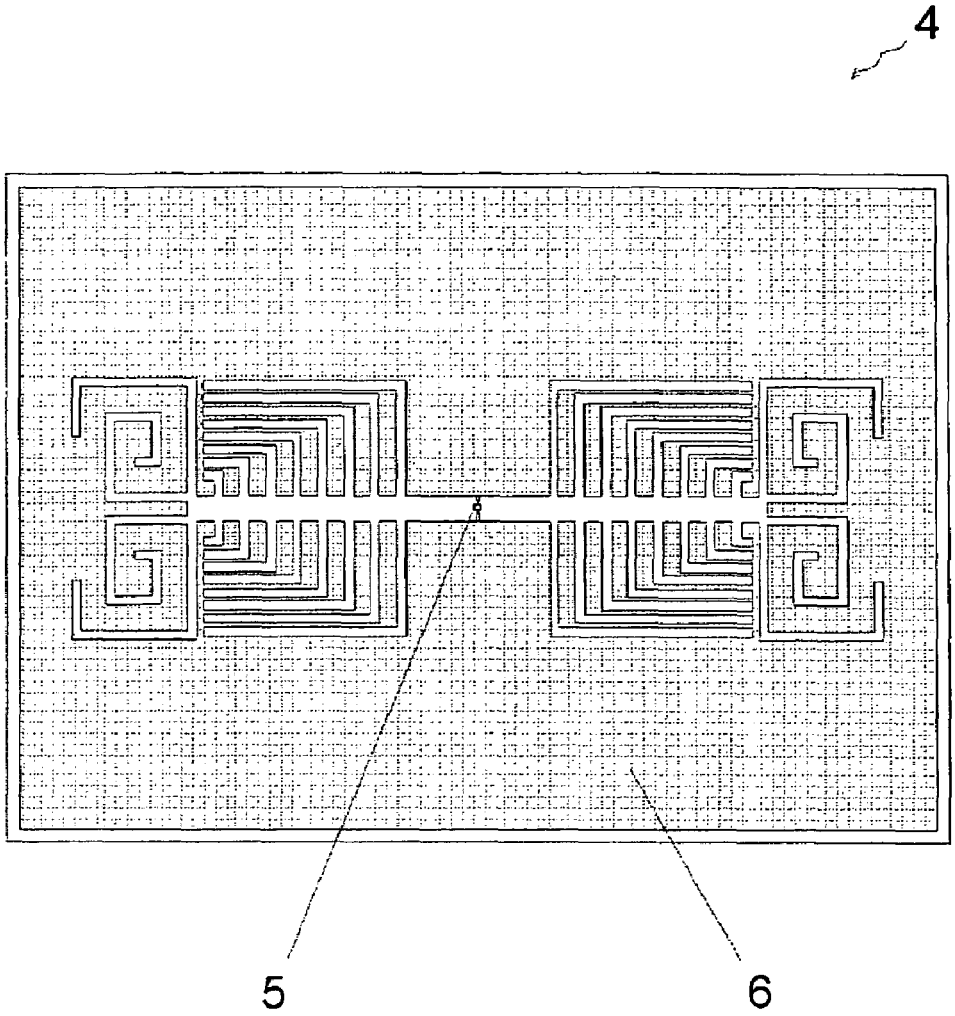
FIG. 4 is a diagram illustrating a small rectenna according to an exemplary embodiment of the present invention.

FIG. 4 is a diagram illustrating a small rectenna 4 according to an exemplary embodiment of the present invention. The rectenna 4 includes a rectifying circuit embedded into an ASIC 5 of the transponder and a connected antenna 6.

Figure 5:
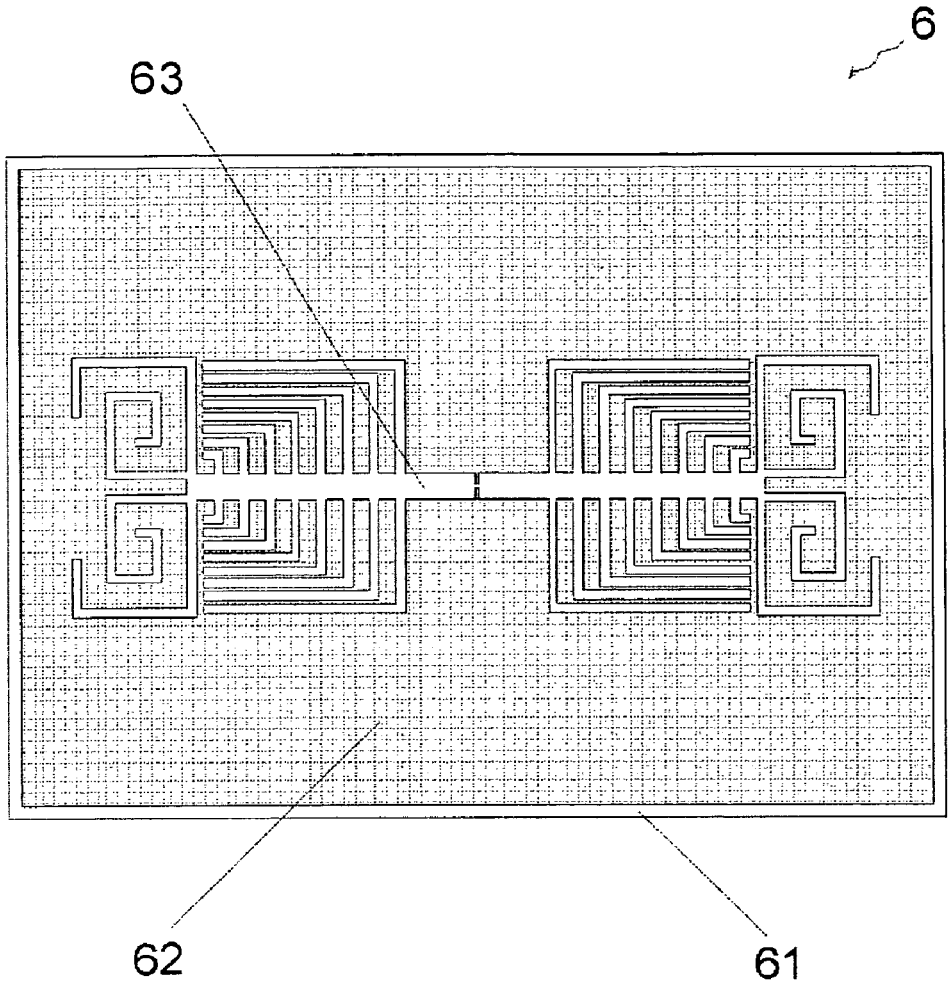
FIG. 5 is a diagram illustrating an antenna of the small rectenna of FIG. 4 according to an exemplary embodiment of the present invention.

FIG. 5 is a diagram illustrating the antenna 6 of the small rectenna 4 of FIG. 4 according to an exemplary embodiment of the present invention. The electrically small antenna 6 has a dielectric substrate 61; a thin conductive layer 62 formed on a top surface of the substrate 61; and a slot pattern 63 within the conductive layer 62. The conductive layer 62 with the slot pattern 63 constitutes a radiating part of the antenna 6.

Figure 6:
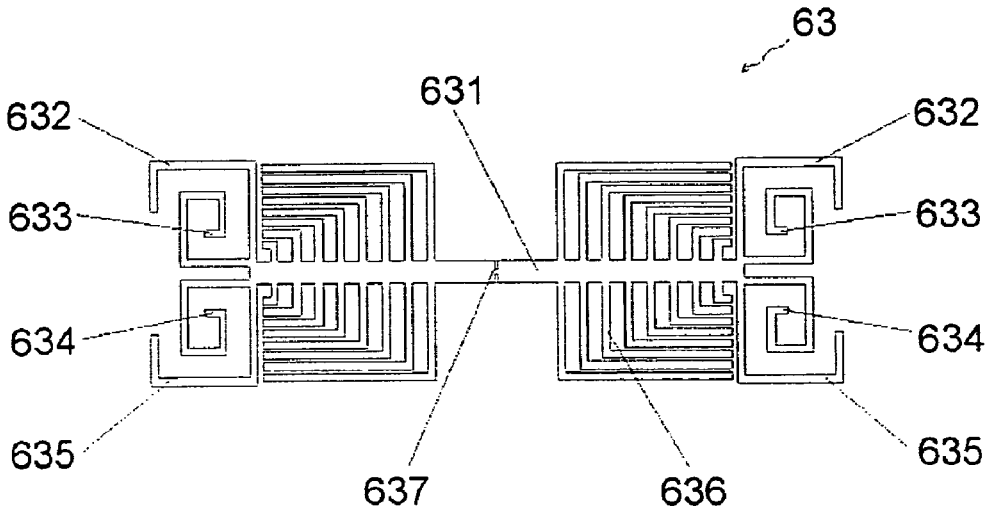
FIG. 6 is a detailed diagram illustrating a slot pattern of the small rectenna of FIG. 4 according to an exemplary embodiment of the present invention.

FIG. 6 is a detailed diagram illustrating a slot pattern 63 of the small rectenna 4 of FIG. 4 according to an exemplary embodiment of the present invention. The slot pattern 63 includes a main slot 631; four slot arms 632, 633, 634 and 635 terminating the main slot 631 at each of both ends so that one pair of arms is convoluted clockwise while another pair is convoluted counterclockwise; and a system of angle sections 636 placed along the main slot 631 so that each angle section is bent toward a nearest end of the main slot 631 while all angle sections 636 are cut into two mirror-symmetrical halves by the main slot 631. The antenna 6 is functionally fed by a direct inlet of an electronic chip ASIC 5 in the slot pattern 63 at feeding point 637.

The theory on how to reduce the size and increase the bandwidth of the antenna while keeping the radiation pattern, gain, and polarization purity from being affected is completely disclosed in Korea Patent Application No. 10-2005-0026496. Since the overall required size of the antenna 6 is substantially less than a quarter wavelength, the length of the main slot 631 is increasingly shorter. Therefore, in order to achieve a required size reduction, a specific value of a finite voltage at both ends of the main slot 631 should be supported so that the desired resonant field distribution on the shortened main slot 631 can be maintained. Also, to arrange the desirable voltage at the ends of the main slot 631, the terminating elements should possess inductive properties.

The slot pattern 63 is configured with four convoluted slot arms 632, 633, 634 and 635 terminating a main slot 631 at each of both ends. One pair of terminating slot arms is convoluted clockwise while another pair is convoluted counterclockwise. The slot arms are further formed as mirror-symmetrical couples with respect to the longitudinal axis of main slot line 631.

In order to arrange specified inductive properties of the antenna 6 as seen from the feeding point 637, the system of additional angle sections 636 is utilized. There are at least two angle sections 636. In contrast to the related art slot pattern 33 having straight transverse slots 336, the angle sections 636 according to the exemplary embodiment of the present invention have shapes that are substantially bent at a right angle. There are two groups of angle sections 636 formed on either side of the main slot 631. Each of the two groups is bent toward the nearest end of the main slot 631. Namely, the left group is bent toward the left end while the right group is bent toward the right end of the main slot 631. The system of angle sections 636 is further placed along the main slot 631 so that all angle sections 636 are mirror-symmetrically cut into two halves by the main slot 631.

The resistive part of the antenna impedance is produced by a radiation phenomenon plus the losses in conductive and dielectric materials that constitute the antenna. The reactive part of the antenna impedance represents power stored in the near field of the antenna.

Figure 7:
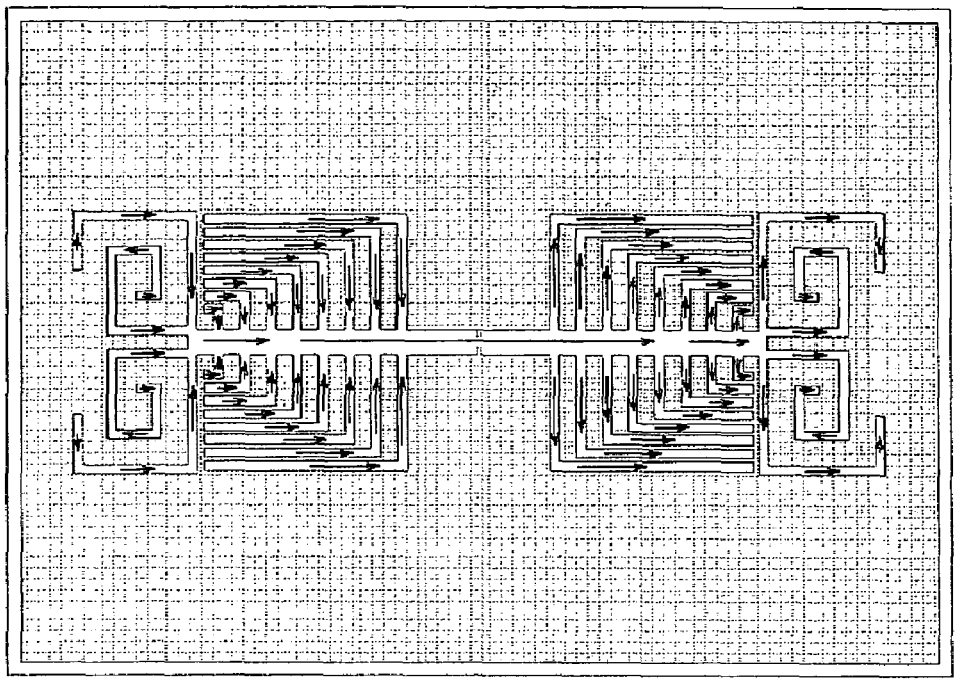
FIG. 7 is a diagram illustrating a scheme of an instantaneous distribution of a magnetic current density in the small rectenna of FIG. 4 according to an exemplary embodiment of the present invention.
Figure 8:
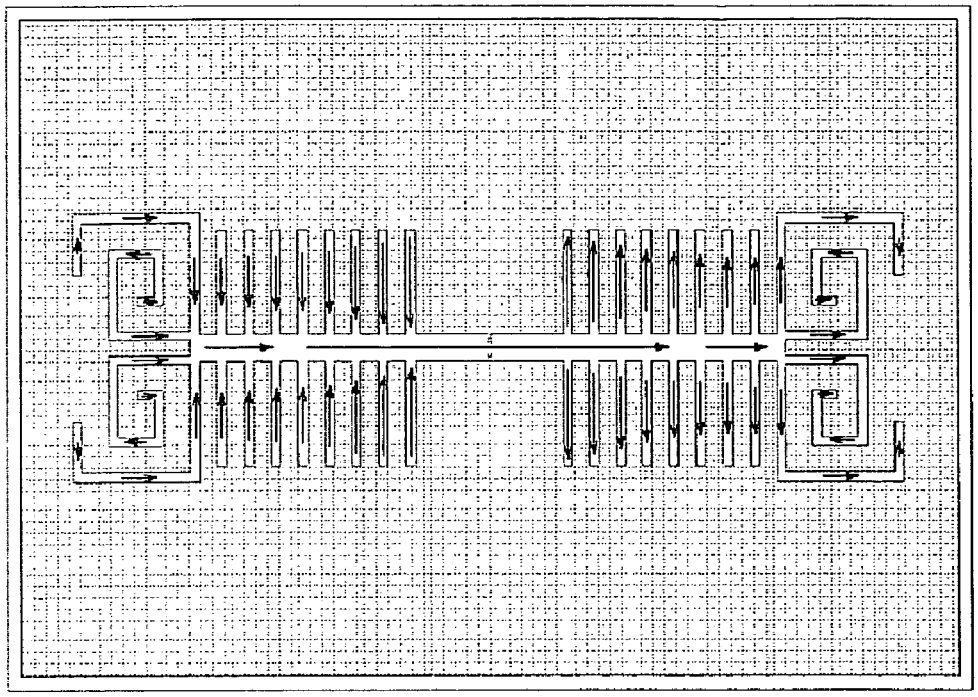
FIG. 8 (RELATED ART)
FIG. 8 is a diagram illustrating a scheme of an instantaneous distribution of the magnetic current density in the rectenna of FIG. 1.

A key principle of the operation of the exemplary embodiment of the present invention can be most conveniently explained by using an equivalent magnetic current at the slot pattern. The term "magnetic current" means a transverse electric field at the slot line. In the case of an electrically small antenna, the phase difference of the electromagnetic field along the radiating part is small, so an instantaneous distribution of the magnetic current density can be schematically shown by arrows of proportional length as in FIG. 7. The instantaneous distribution of the magnetic current density of the related art antenna is shown in FIG. 8.

The impact of the magnetic current over convoluted slot arms 632, 633, 634, 635 has been disclosed in Korea Patent Application No. 10-2005-0026496.

Putting the angle sections 636 along the main slot 631 interferes with the electromagnetic field over the antenna. The angle sections 636 include two types of slot segments strictly oriented in parallel to the longitudinal axis of the main slot 631, i.e., a first type, and perpendicular to the longitudinal axis of the main slot 631, i.e., a second type. As shown in FIG. 7 a flow of magnetic current over all parallel segments is in the same direction as at the flow in the main radiating slot 631. Therefore, the useful part of the magnetic current at the angle sections 636 is reclaimed successfully, thereby increasing the area of the antenna that effectively participates in the radiation phenomenon. Also, since the main slot 631 divides all the angle sections 636 into two halves, the radiated fields from opposite halves in the perpendicular segments cancel each other due to the symmetry and they do not contribute to a radiated far field. At the same time, unique alteration in a near field distribution impacts substantially on the antenna complex impedance.

Therefore, according to the exemplary embodiment of the present invention, the angle sections 636 contribute to the electromagnetic field of the antenna 6 in a substantially distinct manner. The configuration of the angle sections 636 provides the rectenna with the needed ratio of the reactance to the resistance of an antenna impedance. At the same time the angle sections 636 allow an enhancement of a gain of the antenna 6.

It should be appreciated that the system of the angle sections 636 providing various numbers of slots with various lengths, widths, and spacings, may be formed depending on the particular needed ratio of the reactance to the resistance.

Figure 2:
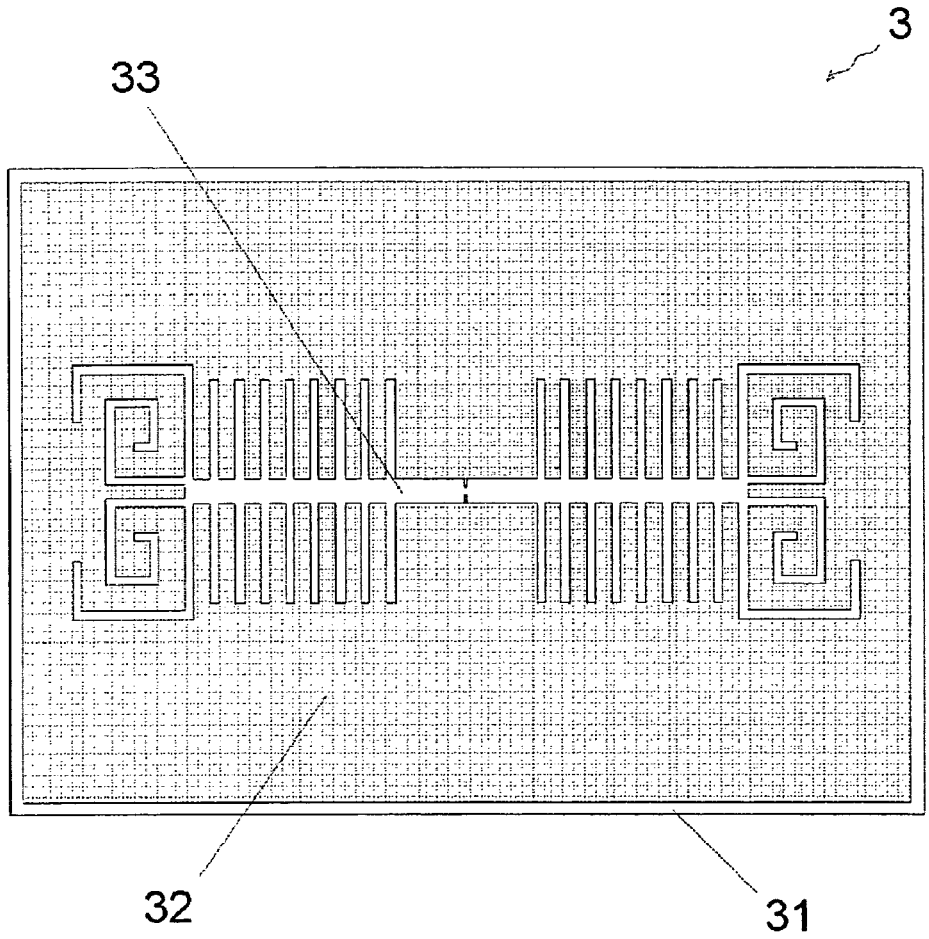
FIG. 2 (RELATED ART)
FIG. 2 is a diagram illustrating an antenna of the rectenna of FIG. 1.
Figure 3:
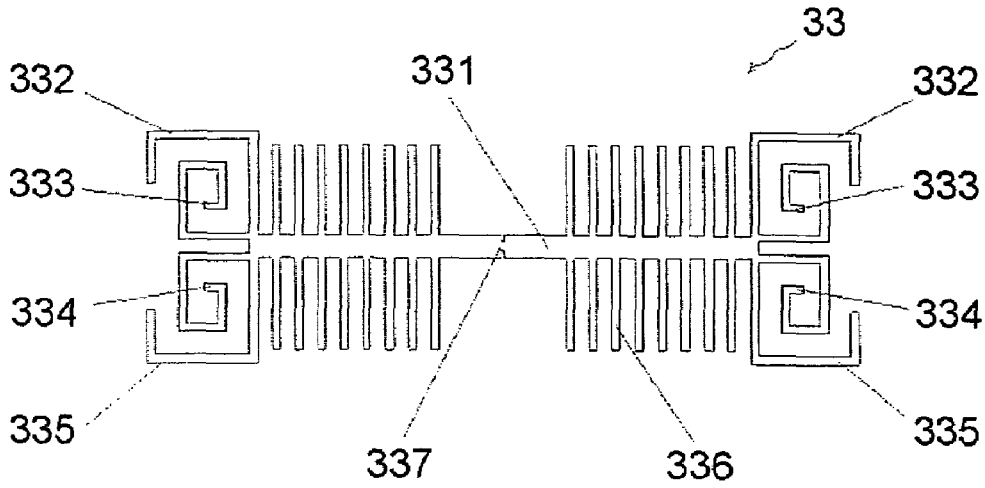
FIG. 3 (RELATED ART)
FIG. 3 is a detailed diagram illustrating a slot pattern of the rectenna of FIG. 1.

In order to properly compare the resulting characteristics of the invented rectenna with the related art rectenna, both rectennas have been designed for UHF under the same size constraints for the conductive layer 62 of FIG. 5 and the metal layer 32 of FIG. 2, and the slot pattern 63 of FIG. 5 and the slot pattern 33 of FIG. 2. Namely, the size of both the conductive layer 62 and the metal layer 32 is $0.21\lambda_0 \times 0.15\lambda_0$ and the size of both the slot pattern 63 and the slot pattern 33 is $0.19\lambda_0 \times 0.06\lambda_0$, where $\lambda_0$ depicts the wavelength in a free space at the center frequency of 915 MHz. The dielectric substrate 61 of FIG. 5 and the dielectric substrate 31 of FIG. 2 have been chosen to have a low-dielectric constant of 3.2, i.e., it is worth mentioning that more miniaturization can be accomplished by increasing the dielectric constant of the substrate material.

Figure 9:
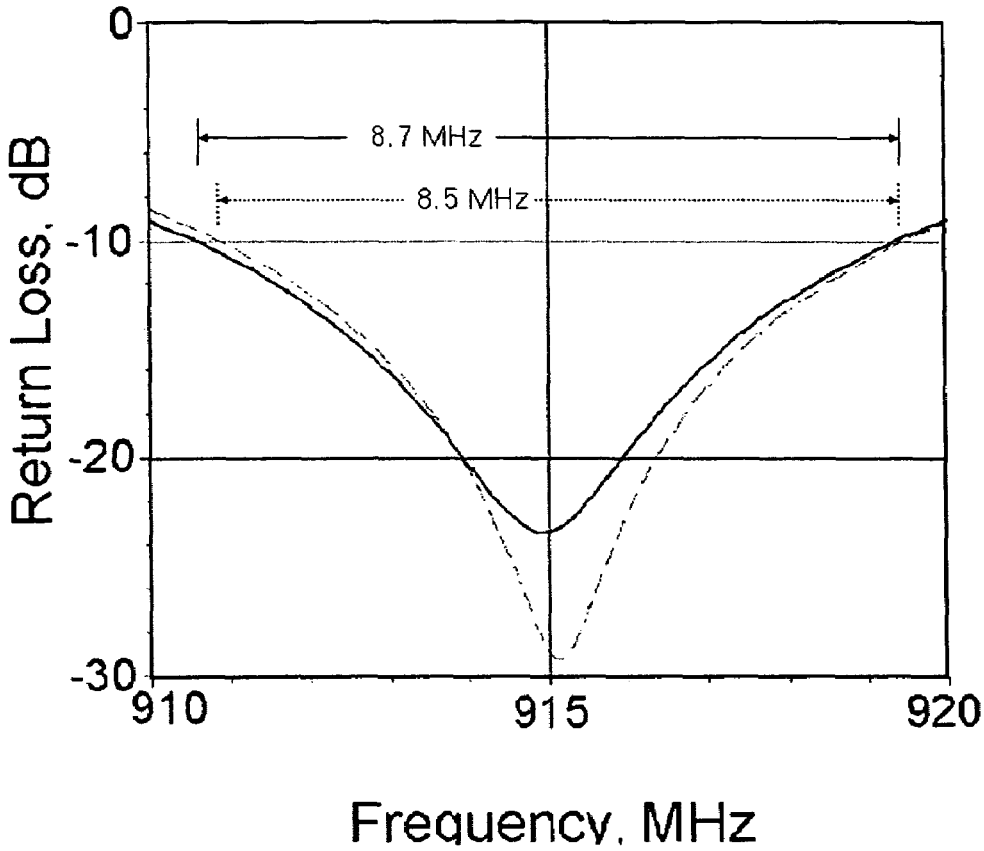
FIG. 9 is a graph illustrating a return loss characteristic of the rectenna matched with the specified complex impedance of an actual ASIC according to an exemplary embodiment of the present invention, in comparison with a return loss characteristic of the rectenna of a related art antenna.

FIG. 9 is a graph illustrating a return loss characteristic of the rectenna matched with the specified complex impedance of an actual ASIC according to an exemplary embodiment of the present invention in comparison to a return loss characteristic of the rectenna of the related art antenna. The exemplary embodiment of the present invention corresponds to the solid line and the related art antenna corresponds to the dashed line. A conjugated impedance of the transponder ASIC is a constant 6-j260 Ohms. It is observed that the achieved operating bandwidth of the rectenna according to the exemplary embodiment of the present invention is 8.7 MHz at the level of −10 dB return loss while the corresponding bandwidth of the related art rectenna is 8.5 MHz. So. the antennas of both rectennas are well conjugate matched with the impedance of the ASIC. However the antenna according to the exemplary embodiment of the present invention has a bandwidth about 200 kHz wider. Such an increased operating bandwidth is sufficient for an actual RFID system.

Figure 10:
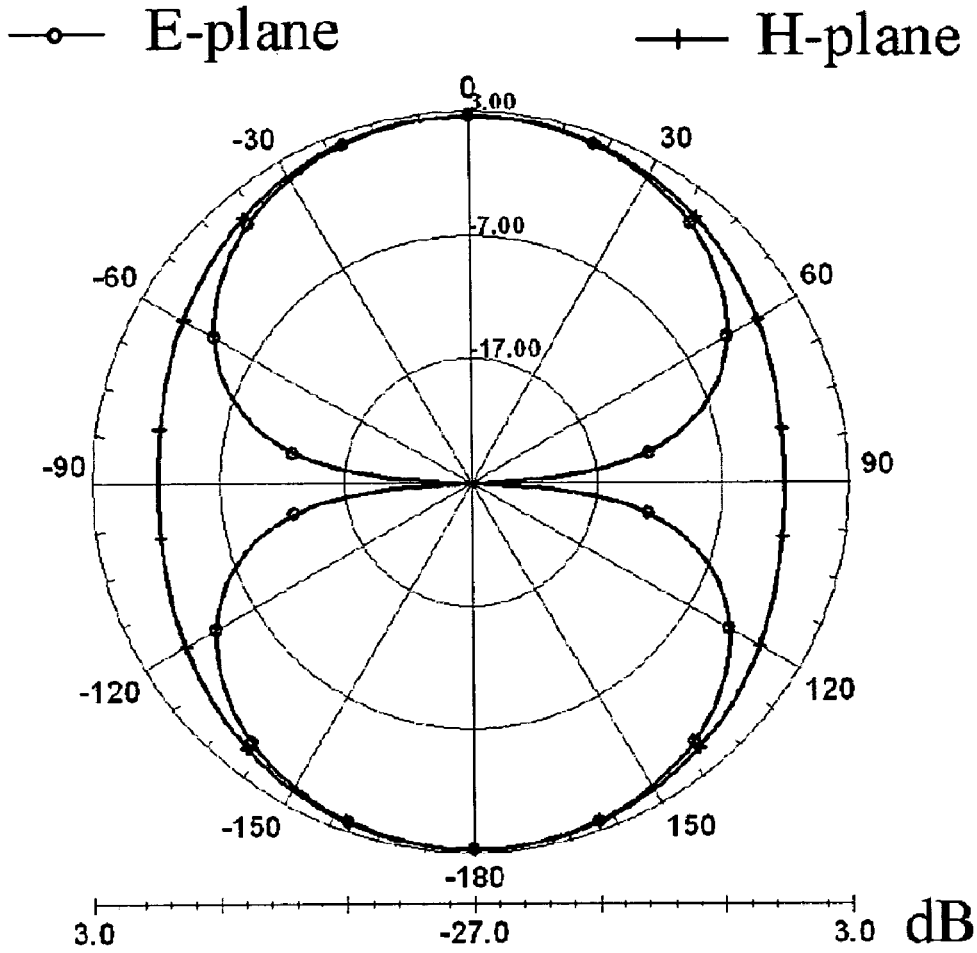
FIG. 10 is a diagram illustrating a radiation pattern of the rectenna according to an exemplary embodiment of the present invention.
Figure 11:
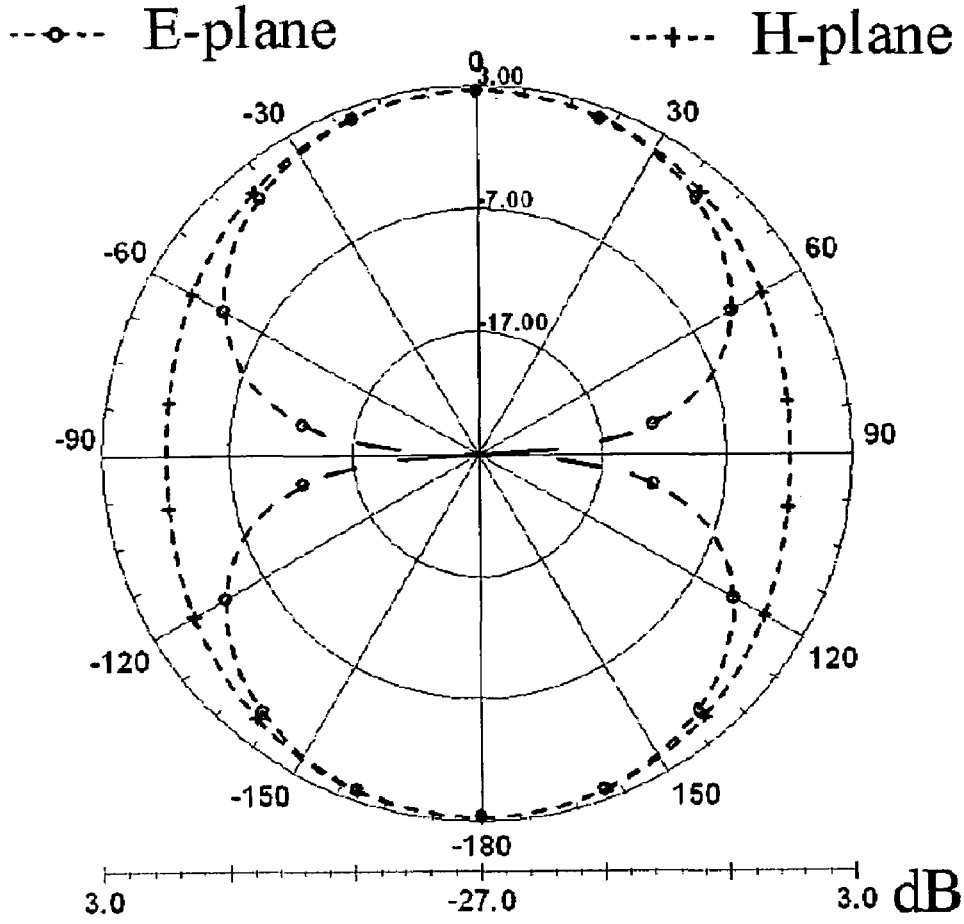
FIG. 11 (RELATED ART)
FIG. 11 is a diagram illustrating a radiation pattern of the rectenna according to a related art.

The radiation pattern in both the principal E-plane and the principal H-plane of the rectenna according to the exemplary embodiment of the present invention is shown in FIG. 10, while the radiation pattern of the related art rectenna is shown in FIG. 11 for comparison. It can be observed that the radiation patterns of both rectennas are very similar. The polarization characteristics of both rectennas are also identical. The polarization is linear.

The RCS characteristics of both rectennas have been compared. In the case of a co-polarized normal incident wave, the RCS at 915 MHz amounts to 230.4 (245.6) centimeters squared at conjugate matching versus 5.3 (5.2) centimeters squared for short-circuit termination for the rectennas according to the exemplary embodiment of the present invention and the related art, respectively. Therefore, both rectennas are capable of modulating the RCS very well for data transmission from a transponder to a reader by backscatter communication.

The gain of +2.63 dBi has been achieved in the exemplary embodiment of the present invention, while the gain of the related art antenna is +2.56 dBi. Accordingly, due to the advantage in gain of the rectenna according to the exemplary embodiment of the present invention, the read range of the overall RFID system is increased.

Figure 12:
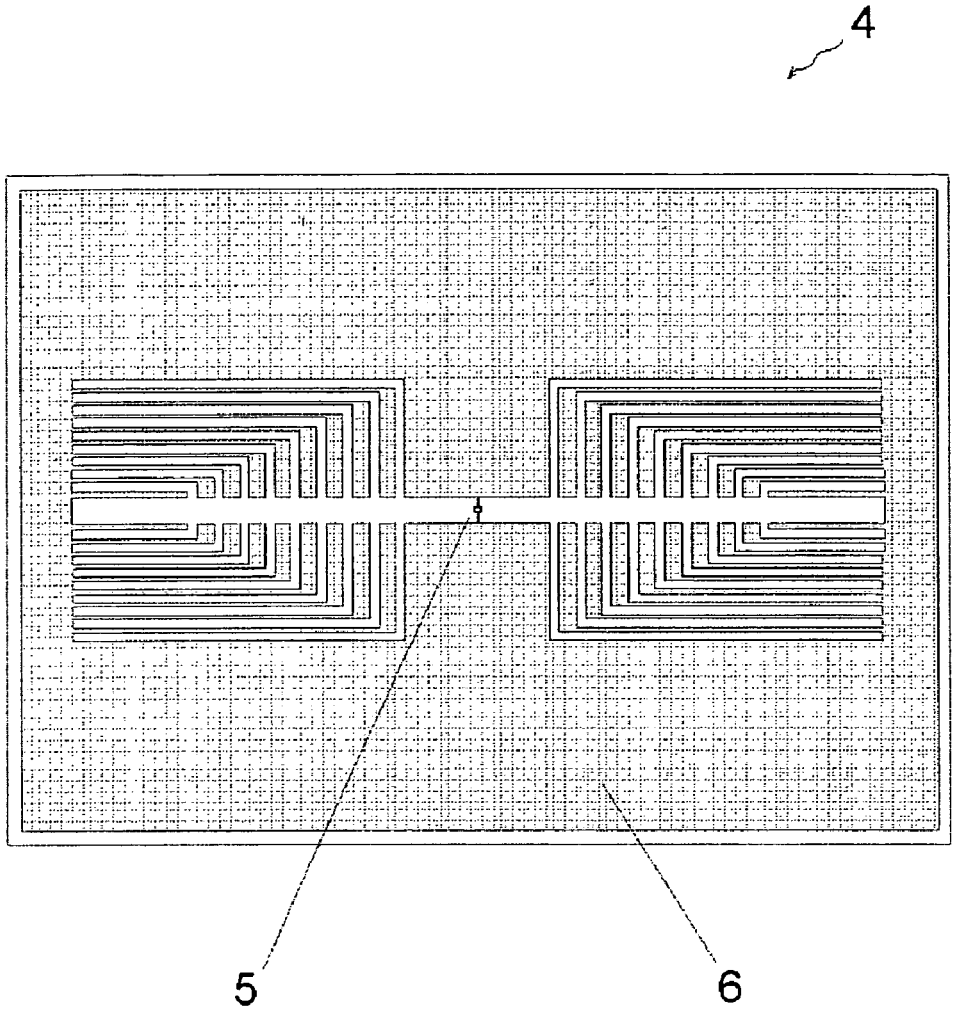
FIG. 12 is a diagram illustrating a rectenna according to another exemplary embodiment of the present invention.

FIG. 12 is a diagram illustrating a rectenna according to another exemplary embodiment of the present invention. In contrast to the previous exemplary embodiment of the present invention shown in FIGS. 4, 5 and 6, there are no convoluted slot arms 632, 633, 634 and 635 as shown in FIG. 6 in the slot pattern of the current exemplary embodiment. Thus, the slot pattern in the current exemplary embodiment of the present invention is composed of only a main slot with angle sections.

Again, in order to correctly compare the resulting characteristics of the rectenna according to the current exemplary embodiment of the present invention with the related art rectenna, both rectennas have been designed for UHF under the same size constraints for the conductive layer 62 of FIG. 5 and the metal layer 32 of FIG. 2 and the slot pattern 63 of FIG. 5 and the slot pattern 33 of FIG. 2. Namely, the size of both the conductive layer 62 and the metal layer 32 is $0.21\lambda_0 \times 0.15\lambda_0$ and the size of both the slot pattern 63 and the slot pattern 33 is $0.19\lambda_0 \times 0.06\lambda_0$, where $\lambda_0$ depicts the wavelength in a free space at the center frequency of 915 MHz, and the dielectric substrate has a low-dielectric constant of 3.2.

Figure 13:
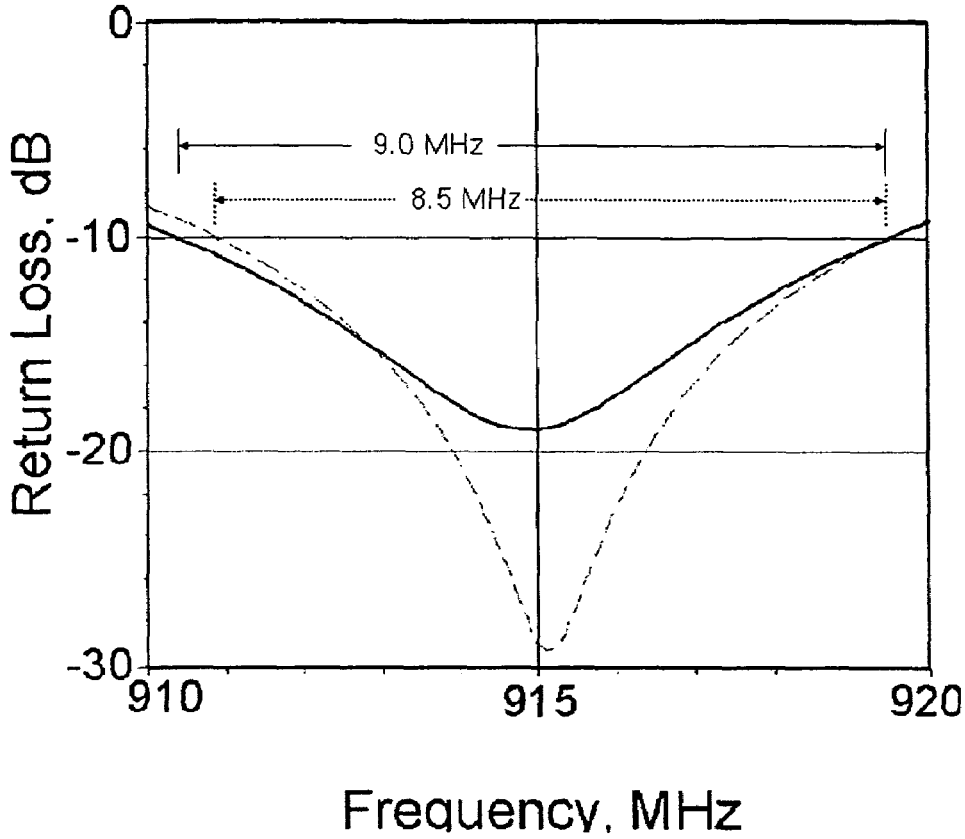
FIG. 13 is a diagram illustrating the return loss characteristic of the antenna matched with the specified complex impedance of the actual ASIC according to the other exemplary embodiment of the present invention in comparison with a related art.

FIG. 13 is a diagram illustrating the return loss characteristic of the antenna matched with the specified complex impedance of the actual ASIC according to the current exemplary embodiment of the present invention in comparison with the related art. The return loss characteristic of the related art rectenna is illustrated in a dashed line, and the return loss characteristic of the current exemplary embodiment of the present invention is illustrated in a solid line. The complex impedance of the transponder ASIC is a constant 6-j260 Ohms.

It is observed that the achieved operating bandwidth of the rectenna according to the current exemplary embodiment of the present invention is 9.0 MHz at a level of −10 dB return loss while the corresponding bandwidth of the related art rectenna is 8.5 MHz. Therefore, the antenna according to the current exemplary embodiment of the present invention has a 500 kHz wider bandwidth.

Figure 14:
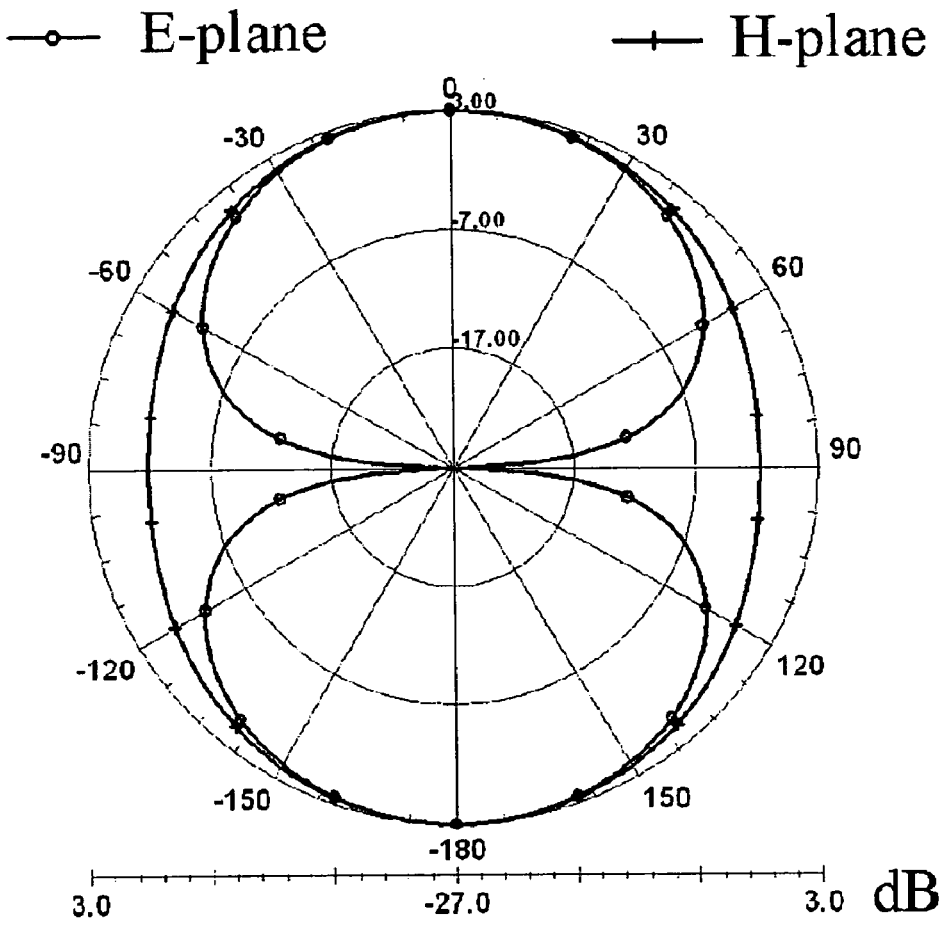
FIG. 14 is a diagram illustrating the radiation pattern of the rectenna according to the other exemplary embodiment of the present invention.

The radiation pattern in both the principal E-plane and the principal H-plane of the current exemplary embodiment of the present invention is shown in FIG. 14. It can be observed that the radiation pattern of the current exemplary embodiment is very similar to both radiation patterns of the previous exemplary embodiment of present invention as shown in FIG. 10 and the related art rectenna as shown in FIG. 11. The polarization characteristics of all rectennas are also identical. The polarization is linear.

The RCS of the rectenna according to the current exemplary embodiment of present invention has been compared with the RCS of the related art rectenna. In the case of a co-polarized normal incident wave, the RCS at 915 MHz amounts to 258.3 (245.6) centimeters squared at conjugate matching versus 5.4 (5.2) centimeter squared at short-circuit termination for the rectennas of the current exemplary embodiment of the present invention and the related art, respectively. Therefore, all rectennas are capable of modulating the RCS very well for data transmission from a transponder to a reader by backscatter communication.

The gain of +2.91 dBi has been achieved for the current exemplary embodiment of the present invention, while the gain of the previous exemplary embodiment is +2.63 dBi and a gain of the related art antenna is +2.56 dBi. Thus, due to an advantage in increased gain of the current exemplary embodiment of the present invention, the read range of the overall 4 RFID system is improved.

As a result, according to the exemplary embodiments of the present invention, there is provided a rectenna with an electrically small conjugate matched antenna having an enhanced gain for an overall increased bandwidth without strongly affecting on polarization and RCS characteristics.

Although a few exemplary embodiments of the present invention have been shown and described, the present invention is not limited to the described embodiments. Instead, it would be appreciated by those skilled in the art that changes may be made to these embodiments without departing from the principles and spirit of the invention, the scope of which is defined by the claims and their equivalents.

What is claimed is:

1. A rectenna for an RFID transponder comprising:

a dielectric substrate;

a conductive layer formed on a surface of the dielectric substrate, wherein the conductive layer comprises a slot pattern comprising a main slot having at least two ends, and a plurality of angle sections placed along the main slot, and wherein each of the angle sections is bent toward a nearest end of the two ends of the main slot, and the angle sections are divided into two mirror-symmetrical halves by the main slot; and a rectifying circuit disposed in the slot pattern, wherein the slot pattern is configured to provide conjugate impedance matching with respect to the rectifying circuit.

2. The rectenna of claim 1, further comprising a plurality of slot arms terminating the main slot at each of two ends of the main slot, wherein the slot arms comprise four convoluted slot arms, and wherein one pair of the four convoluted slot arms is convoluted clockwise and a remaining pair of the four convoluted arms is convoluted counterclockwise.

3. The rectenna of claim 2, wherein the slot arms are arranged as mirror-symmetrical couples with respect to a longitudinal axis of the main slot.

4. The rectenna of claim 1, wherein the dielectric substrate and the conductive layer are substantially planar.

5. The rectenna of claim 1, wherein the rectifying circuit is provided in a form of an application specific integrated circuit (ASIC).

6. The rectenna of claim 1, wherein the slot pattern is configured according to a predetermined ratio of a reactance to a resistance of the conductive layer.

7. A rectenna for an RFID transponder comprising:

a dielectric substrate;

a conductive layer formed on a surface of the dielectric substrate, wherein the conductive layer comprises a slot pattern comprising a main slot having at least two ends, and a plurality of angle sections placed along the main slot, and a rectifying circuit disposed in the slot pattern, wherein magnetic current flowing in the plurality of angle sections comprises magnetic current segments flowing in the same direction as magnetic current flowing in the main slot, and wherein the slot pattern is configured to provide conjugate impedance matching with respect to the rectifying circuit.

* * * * *